US009947978B1

(12) United States Patent
Tavassoli Hozouri

(10) Patent No.: US 9,947,978 B1
(45) Date of Patent: Apr. 17, 2018

(54) ORTHOMODE TRANSDUCER

(71) Applicant: Space Systems/Loral, LLC, Palo Alto, CA (US)

(72) Inventor: Behzad Tavassoli Hozouri, Sunnyvale, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 0 days.

(21) Appl. No.: 15/180,444

(22) Filed: Jun. 13, 2016

(51) Int. Cl.

| | |
|---|---|
| ***H01Q 15/24*** | (2006.01) |
| ***H01P 1/161*** | (2006.01) |
| ***H01Q 15/14*** | (2006.01) |
| ***H01Q 1/50*** | (2006.01) |
| ***H01Q 21/00*** | (2006.01) |
| ***H01P 1/165*** | (2006.01) |
| ***H01P 1/213*** | (2006.01) |

(52) U.S. Cl.
CPC ..... *H01P 1/161* (2013.01); *H01P 1/165* (2013.01); *H01P 1/2131* (2013.01); *H01Q 1/50* (2013.01); *H01Q 15/14* (2013.01); *H01Q 15/242* (2013.01); *H01Q 15/246* (2013.01); *H01Q 21/0006* (2013.01)

(58) Field of Classification Search
CPC .... H01Q 15/24; H01Q 15/242; H01Q 15/246; H01P 1/161; H01P 1/165; H01P 1/2131; H01P 1/066; H01P 1/067; H01P 1/171
See application file for complete search history.

(56) References Cited

U.S. PATENT DOCUMENTS

| | | | |
|---|---|---|---|
| 4,126,835 | A | 11/1978 | Gould |
| 4,395,685 | A | 7/1983 | Davies et al. |
| 6,118,412 | A | 9/2000 | Chen |
| 6,522,215 | B2 | 2/2003 | Enokuma |
| 6,724,277 | B2 | 4/2004 | Holden et al. |
| 6,842,085 | B2 | 1/2005 | Chen et al. |
| 7,397,323 | B2 | 7/2008 | Hozouri |
| 8,994,474 | B2 | 3/2015 | Mahon et al. |
| 9,147,921 | B2 | 9/2015 | Delgado |
| 2014/0266942 | A1 | 9/2014 | Voss et al. |

FOREIGN PATENT DOCUMENTS

| | | | | |
|---|---|---|---|---|
| DE | 44 37 594 | A1 | 5/1996 | |
| EP | 2535978 | A1 * | 12/2012 | ..... H01P 1/161 |

* cited by examiner

*Primary Examiner* — Hoang Nguyen
(74) *Attorney, Agent, or Firm* — Weaver Austin Villeneuve & Sampson LLP

(57) ABSTRACT

An orthomode transducer (OMT) configured as a compact three port septum polarizer waveguide where one of the three ports is configured to propagate linear orthogonally polarized signals, and an edge of the septum facing that port has a profile including three or more segments with respective facing edges spaced at diverse respective distances from the one of the three ports that is configured to propagate linear orthogonally polarized signals. The three or more segments include one or both of a notch and a protrusion.

20 Claims, 5 Drawing Sheets

ORTHOMODE TRANSDUCER

TECHNICAL FIELD

This disclosure relates to a radio frequency (RF) electromagnetic waveguide device for combining or separating two, respectively orthogonal, linearly polarized signals, and more particularly to an orthomode transducer with improved performance and compact size that can be used for single band and multi-band frequency applications.

BACKGROUND OF THE INVENTION

A waveguide orthomode transducer (OMT) is a three-port radio frequency device that can be used as a polarization diplexer for combining or separating two, respectively orthogonal, linearly polarized signals. Two of the three ports are coupled with two respective waveguides carrying single linearly polarized electromagnetic signals, whereas, the third of the three ports is coupled with a waveguide carrying two orthogonal linear polarized signals.

An OMT can provide for a concurrent transmission of signals of differing frequencies and differing linear polarizations through a common antenna and are therefore useful for many communication satellite applications. There are various types of OMTs. Some are based on turnstile waveguide junctions such as described in the present inventor's U.S. Pat. No. 7,397,323. In other types of OMTs, the two waveguides carrying single polarized electromagnetic signals are perpendicular to each other and/or to the waveguide carrying the two orthogonal linear polarized signals.

Modern satellites can include antennas having a reflector with a feed array located in its focal plane while using orthogonal linearly polarized signals. Satellite payload requirements are driving a need for feed arrays with numerous feed array elements. The size of each feed array element is, desirably, as small as possible. In the absence of the presently disclosed techniques, the size of such feed arrays may be driven by the OMT size.

Accordingly, there is a need for a more compact, high performance, OMT design.

SUMMARY OF INVENTION

According to some implementations an apparatus includes an orthomode transducer (OMT), the OMT including a waveguide having a first port, disposed at a proximal portion of the waveguide and configured to propagate first linearly polarized signals, a second port disposed adjacent to the first port and configured to propagate second linearly polarized signals, a third port disposed at a distal portion of the waveguide and configured to propagate linear orthogonally polarized signals, and a septum disposed inside the waveguide. The OMT is configured to perform one or both of combining or separating the first and second linearly polarized signals and the septum includes a facing edge, the facing edge including a first edge segment proximal to a first sidewall of the waveguide, a second edge segment proximal to a second sidewall of the waveguide, and one or more of: (1) a protrusion disposed between the first edge segment and the second edge segment that extends farther toward the third port than both of the first edge segment and the second edge segment; (ii) a notch that extends a lesser distance toward the third port than both of the first edge segment and the second edge; and (iii) one or more protrusions and notches, each protrusion extending farther toward the third port than one or more of the first edge, the second edge and at least one notch, each notch extending a lesser distance toward the third port than one or more of the first edge, the second edge and at least one protrusion.

In some examples, the facing edge may include no portion facing away from the third port. In some examples, each edge segment, protrusion and notch may at least partly face the distal portion of the waveguide.

In some examples, the first port and second port may include respective rectangular waveguide portions, each rectangular waveguide portion having a respective characteristic broad wall dimension and a respective characteristic narrow wall dimension. In some examples, the respective rectangular waveguide portions may share a common broad wall. In some examples the characteristic broad wall dimension may be approximately two times wider than each respective characteristic narrow wall dimension. In some examples, the third port may include a square waveguide.

In some examples, one or more of the first edge segment, the second edge segment, the protrusion and the notch may be orthogonal to a longitudinal axis of the OMT.

In some examples, one or more of the first edge segment, the second edge segment, the protrusion and the notch may not be orthogonal to a longitudinal axis of the OMT.

In some examples, at least a portion of the facing edge may be a curvilinear surface.

In some examples, the third port may be configured to couple with a circular waveguide.

According to some implementations, an antenna system, includes a reflector and a feed array, the feed array including a plurality of feed array elements, at least one of the feed array elements including an orthomode transducer (OMT), the OMT including a waveguide having a first port, disposed at a proximal portion of the waveguide and configured to propagate first linearly polarized signals, a second port disposed adjacent to the first port and configured to propagate second linearly polarized signals, a third port disposed at a distal portion of the waveguide and configured to propagate linear orthogonally polarized signals, and a septum disposed inside the waveguide. The OMT is configured to perform one or both of combining or separating the first and second linearly polarized signals and the septum includes a facing edge, the facing edge including a first edge segment proximal to a first sidewall of the waveguide, a second edge segment proximal to a second sidewall of the waveguide, and one or more of: (1) a protrusion disposed between the first edge segment and the second edge segment that extends farther toward the third port than both of the first edge segment and the second edge segment; (ii) a notch that extends a lesser distance toward the third port than both of the first edge segment and the second edge; and (iii) one or more protrusions and notches, each protrusion extending farther toward the third port than one or more of the first edge, the second edge and at least one notch, each notch extending a lesser distance toward the third port than one or more of the first edge, the second edge and at least one protrusion.

BRIEF DESCRIPTION OF THE DRAWINGS

Features of the invention are more fully disclosed in the following detailed description of the preferred embodiments, reference being had to the accompanying drawings, in which.

Figure 1A:
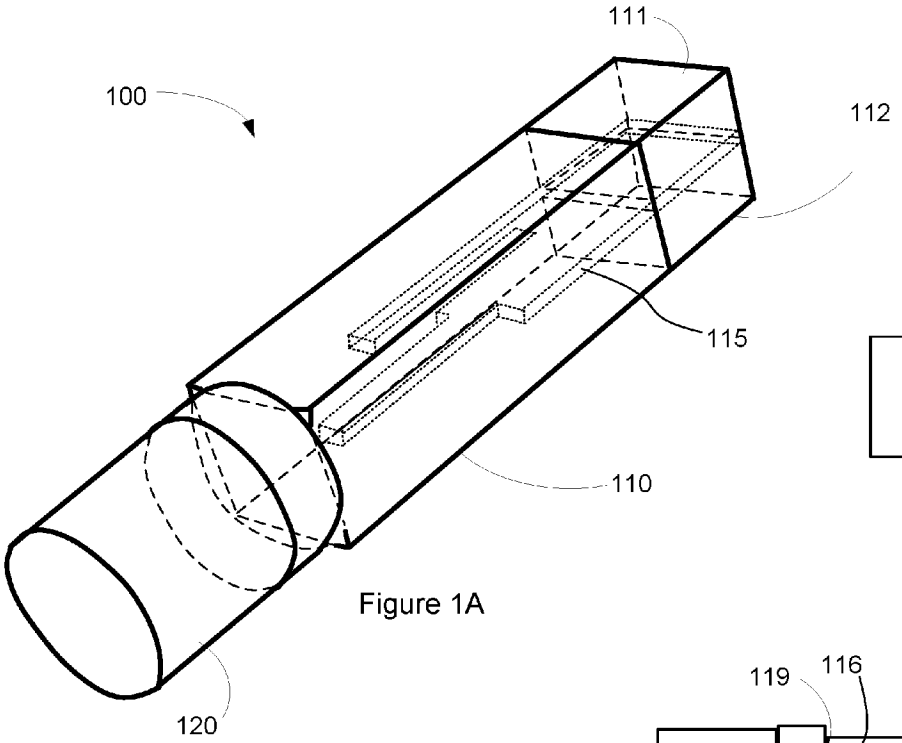
FIGS. 1A-C show an example of an orthomode transducer (OMT), according to an implementation.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the disclosed subject matter, as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. Furthermore, "connected" or "coupled" as used herein may include wirelessly connected or coupled. It will be understood that although the terms "first" and "second" are used herein to describe various elements, these elements should not be limited by these terms. These terms are used only to distinguish one element from another element. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

The present inventor has appreciated that an orthomode transducer (OMT) may be advantageously configured as a compact three port septum polarizer waveguide where one of the three ports is configured to propagate linear orthogonally polarized signals, and an edge of the septum facing that port (the "facing edge") has a specially shaped profile, as disclosed hereinbelow, that improves manufacturability and performance relative to known alternatives. The specially shaped profile may be generally characterized as including three or more segments with respective facing edges spaced at diverse respective distances from the one of the three ports that is configured to propagate linear orthogonally polarized signals.

Figure 1B:
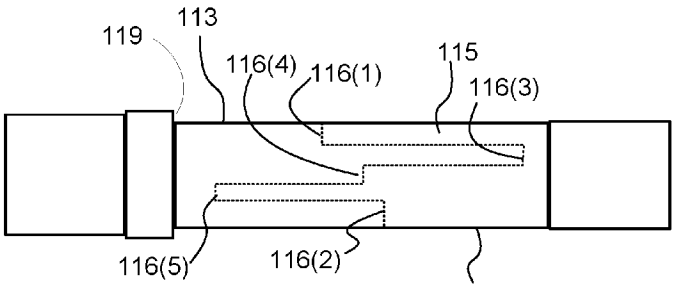
Figure 1C:
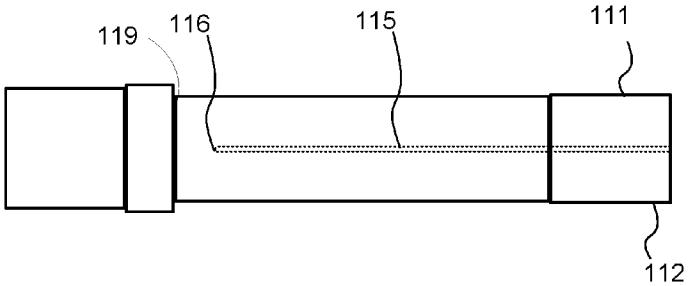

Referring now to FIGS. 1A-1C, an example of an OMT according to an implementation is illustrated. FIGS. 1A, 1B, and 1C depict views of OMT 100 that may be referred to, for convenience, respectively as a perspective view, a top or plan view and a side or elevation view. The OMT 100 includes a three port waveguide 110. The waveguide 110 includes a first port 111 and an adjacent second port 112, each disposed proximate to a first end of the waveguide 110, and a third port 119 disposed proximate to an opposite end of the waveguide 110. In the illustrated implementation, the first port 111 and the second port 112 may each include a rectangular waveguide portion configured to propagate respective linearly polarized signals. As illustrated, the first port 111 and the second port 112 may be arranged such that the rectangular waveguide portions have a common wide (or H-plane) wall. The OMT 100 also includes a planar septum 115 disposed inside the waveguide 110 in a plane substantially aligned with the common wall.

In the illustrated implementation, the septum 115, as may be most clearly observed in FIG. 1B, includes a facing edge 116 that includes five edge segments disposed at different respective differences from the third port 119. More particularly, the facing edge 116 includes a first edge segment 116(1) proximal to a first sidewall 113 of the waveguide 110, and a second edge segment 116(2) proximal to a second sidewall 114 of the waveguide 110. It may also be observed that a third edge segment 116(3), that may be referred to as a "notch" or "notch segment", is disposed so as to be farther from the third port 119 than edge segments 116(1) and 116 (4) that are adjacent to notch segment 116(3). It may also be observed that a fifth edge segment 116(5), that may be referred to as a "protrusion" or "protrusion segment", is disposed so as to be closer to the third port 119 than edge segments 116(2) and 116 (4) that are adjacent to protrusion segment 116(5).

The septum 115 may be configured to transform signals propagating between a proximal end of the OMT (through the port 111 and/or the port 112) and a distal end of the OMT through port 119. More particularly, a polarization axis of a linearly polarized electromagnetic signal propagating in the TE10 mode through either of the rectangular waveguide portion associated with the port 111 or the rectangular waveguide portion associated with the port 112, may, through the action of the septum, be rotated by an increment of +45° or −45° with respect to the septum plane. Likewise, when linearly polarized signals are introduced simultaneously in both of the rectangular waveguide portions, a polarization axis of one of the two linearly polarized electromagnetic signals may be rotated by an increment of +45° whereas a polarization axis of the other of the two linearly polarized electromagnetic signals may be rotated by an increment of −45°. As a result, the linearly polarized electromagnetic signals may be said to have been combined into linear orthogonally polarized signals. The resulting linear orthogonally polarized signals may be propagated through the waveguide 110 toward and through the port 119. It will be appreciated that the two linear orthogonally polarized signals may constitute separate information channels and be isolated from one another, so that there is negligible interference between them. For easier connection with a radiating element, which is usually a rotationally symmetric horn antenna, the waveguide 110 may have a square cross section that is transitioned to a circular waveguide 120, as shown in the illustrated implementation.

In the illustrated implementation, each of the port 111 and the port 112 is configured with a rectangular cross-section in which a narrow wall has a characteristic narrow wall dimension that is approximately one half the width of the waveguide 110, but this is not necessarily the case. For example, the combined width of ports 111 and 112 may be larger than that of waveguide 110. Similarly a characteristic broad wall dimension of the ports 111 and 112 may be larger than the width of waveguide 110.

The foregoing description related to operation of the OMT 100 as a combiner. It will be appreciated that, alternatively or in addition, the OMT 100 may be operated as a splitter. When operated as a splitter, the OMT 100 may separate linear orthogonally polarized signals received through port 119 into two linearly polarized electromagnetic signals and propagate respective separated linearly polarized electromagnetic signals toward and through respective first port 111 and second port 112.

Figure 2:
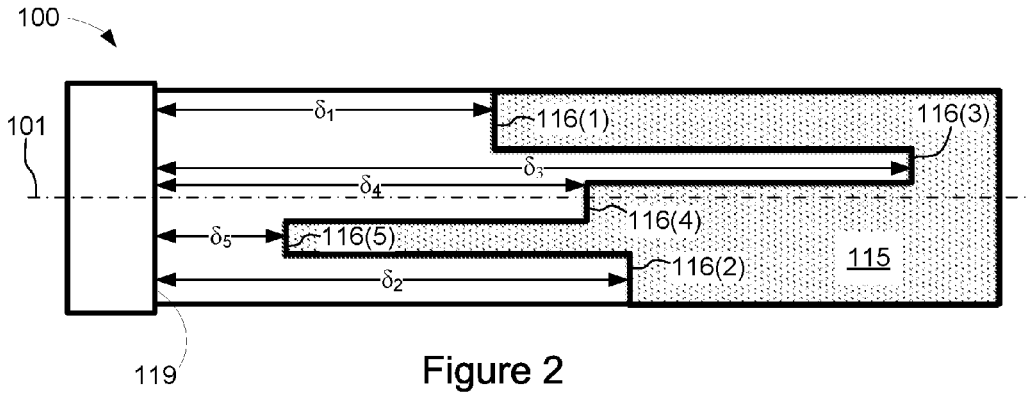
FIG. 2 shows an example of a septum of an OMT, according to an implementation.

In the implementation illustrated in FIG. 1, the septum 115 includes exactly one notch (edge segment 116(3)) and one protrusion (edge segment 116(5)). A number of other arrangements are within the contemplation of the present disclosure, some illustrative examples of which will now be described. FIG. 2 provides, for purposes of comparison, an enlarged and annotated illustration of the septum 115 as disposed with respect to the port 119 of the OMT 100. It may be observed that each of the edge segments 116(*i*) has been annotated to indicate a respective distance $\delta_i$, parallel to a longitudinal axis 101 of the OMT 100, between the edge segment 116(*i*) and the port 119. In the illustrated implementation, $\delta_1$ is less than $\delta_2$, but this is not necessarily so. In other implementations $\delta_1$ may be larger than or equal to equal to $\delta_2$. In the illustrated implementation, there is a single edge segment 116(4) configured as a "step" segment disposed between the protrusion segment 116(5) and the notch segment 116(3). In other implementations, multiple step segments may be contemplated and may be disposed (as illustrated) between a notch segment and a protrusion segment or between a notch segment and a sidewall of the waveguide 110, or between a protrusion segment and a sidewall of the waveguide 110. In some implementations, no step segments are contemplated. For clarity of illustration, step segments are omitted from the implementations illustrated in FIGS. 3-12 described hereinbelow, but it will be understood that one or more step segments may be also included in any of the following implementations. In the illustrated implementation, there is exactly one notch segment 116(3) and exactly one protrusion segment 116(5), but it is contemplated that, in other implementations two or more notch segments and/or two or more protrusion segments may be provided. Furthermore, as will be described in connection with FIGS. 4 and 5, some implementations omit a notch section (FIG. 4) while other implementations omit a protrusion segment (FIG. 5).

Figure 3:
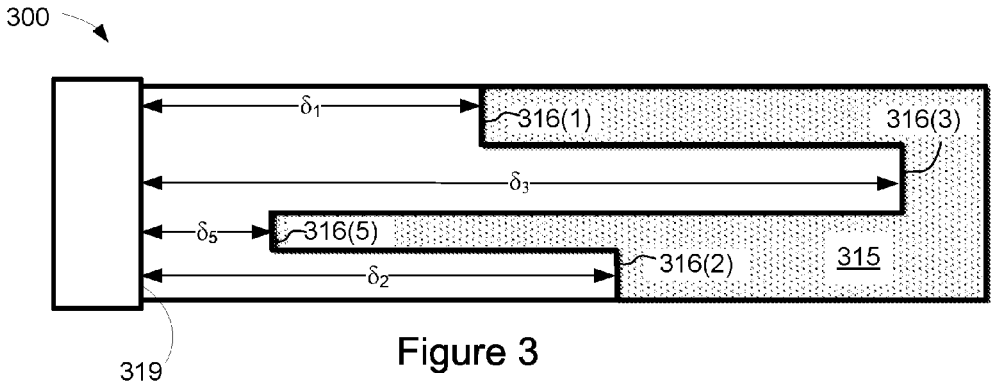
FIG. 3 shows an example of a septum of an OMT, according to another implementation.

FIG. 3 provides an illustration of a septum 315 as disposed with respect to a port 319 of an OMT 300. In the illustrated implementation, a single notch segment 316(3) and a single protrusion segment 316(5) are disposed between a first edge segment 316(1) and a second edge segment 316(2). In the illustrated implementation, it may be observed that a distance $\delta_3$ between the notch segment 316(3) and the port 319 is greater than both of distances $\delta_1$ and $\delta_2$, where $\delta_1$ is the distance between a first edge segment 316(1) and the port 319, and $\delta_2$ is the distance between a second edge segment 316(2) and the port 319. In other implementations, however, $\delta_3$ may be greater than only one of $\delta_1$ and $\delta_2$. Likewise, in the illustrated implementation, it may be observed that a distance $\delta_5$ between the protrusion segment 316(5) and the port 319 is less than both of distances $\delta_1$ and $\delta_2$. In other implementations, however, $\delta_5$ may be less than only one of $\delta_1$ and $\delta_2$.

Figure 4:
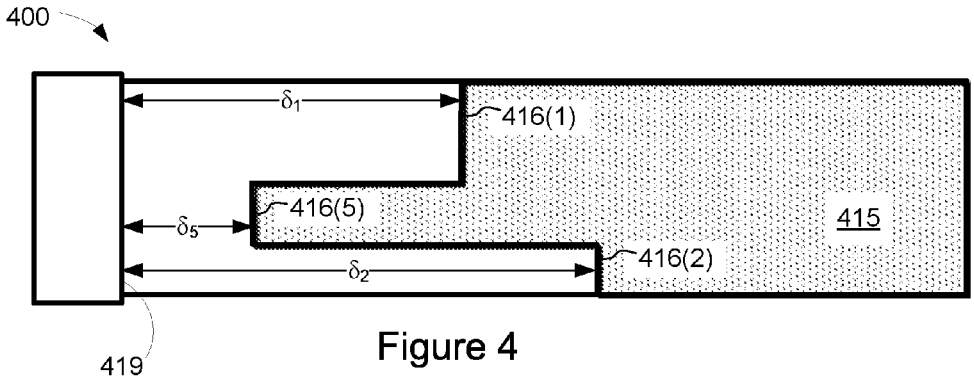
FIG. 4 shows an example of a septum of an OMT, according to a further implementation.

FIG. 4 provides an illustration of a septum 415 as disposed with respect to a port 419 of an OMT 400. In the illustrated implementation, a single protrusion segment 416(5) is disposed between a first edge segment 416(1) and a second edge segment 416(2). In the illustrated implementation, it may be observed that a distance $\delta_5$ between the protrusion segment 416(5) and the port 419 is less than both of distances $\delta_1$ and $\delta_2$, that is, the protrusion segment 416(5) extends farther toward the port 419 than both of the first edge segment 416(1) and the second edge segment 416(2).

Figure 5:
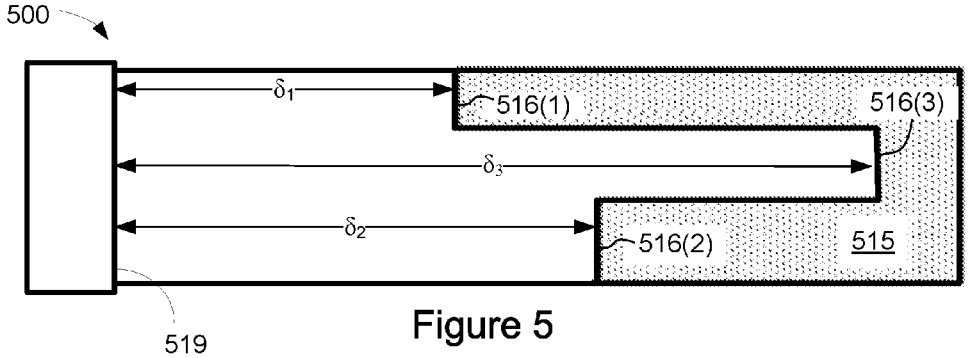
FIG. 5 shows an example of a septum of an OMT, according to yet further implementation.

FIG. 5 provides an illustration of a septum 515 as disposed with respect to a port 519 of an OMT 500. In the illustrated implementation, a single notch segment 516(3) is disposed between a first edge segment 516(1) and a second edge segment 516(2). In the illustrated implementation, it may be observed that a distance $\delta_3$ between the notch segment 516(3) and the port 519 is greater than both of distances $\delta_1$ and $\delta_2$, that is, the notch segment 516(5) extends a lesser distance toward the port 519 than both of the first edge segment 516(1) and the second edge segment 516(2).

Figure 6:
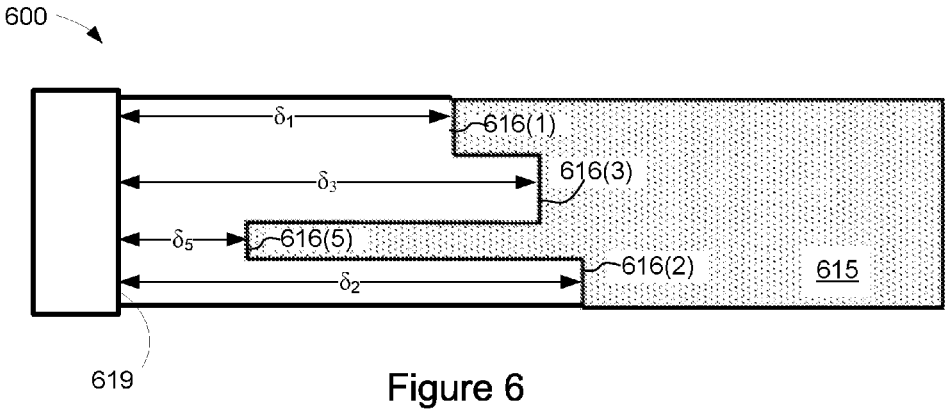
FIG. 6 shows an example of a septum of an OMT, according to another implementation.

FIG. 6 provides an illustration of a septum 615 as disposed with respect to a port 619 of an OMT 600. In the illustrated implementation, a single notch segment 616(3) and a single protrusion segment 616(5) are disposed between a first edge segment 616(1) and a second edge segment 616(2). In the illustrated implementation, it may be observed that a distance $\delta_3$ between the notch segment 616(3) and the port 619 is greater than distance $\delta_1$ and less then distance $\delta_2$. That is, the notch segment 616(3) extends a lesser distance toward the port 619 than the second edge segment 616(1). In the illustrated implementation, it may also be observed that a distance $\delta_5$ between the protrusion segment 616(5) and the port 619 is less than both of distances $\delta_1$ and $\delta_2$.

Figure 7:
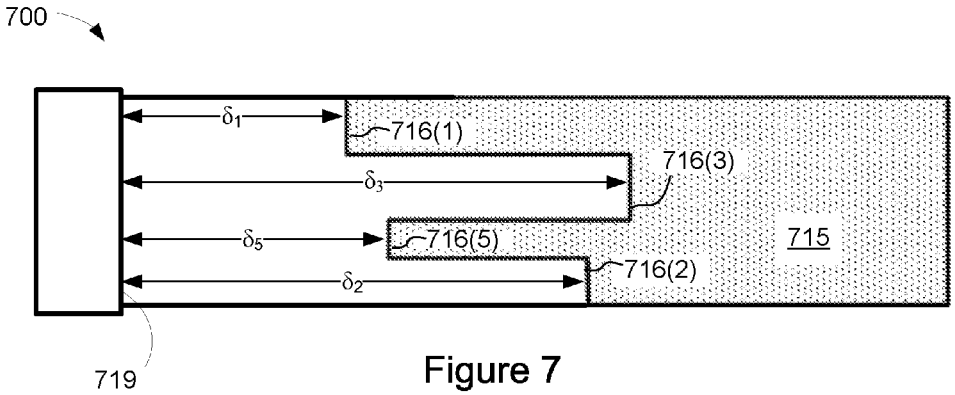
FIG. 7 shows an example of a septum of an OMT, according to a further implementation.

FIG. 7 provides an illustration of a septum 715 as disposed with respect to a port 719 of an OMT 700. In the illustrated implementation, a single notch segment 716(3) and a single protrusion segment 716(5) are disposed between a first edge segment 716(1) and a second edge segment 716(2). In the illustrated implementation, it may be observed that a distance $\delta_5$ between the protrusion segment 716(5) and the port 719 is greater than distance $\delta_1$ and less then distance $\delta_2$. That is, the protrusion segment 716(5) extends a farther distance toward the port 719 than the second edge segment 716(2) and extends a lesser distance toward the port 719 than the first edge segment 716(1). In the illustrated implementation, it may also be observed that a distance $\delta_3$ between the notch segment 716(3) and the port 719 is greater than both of distances $\delta_1$ and $\delta_2$.

Figure 8:
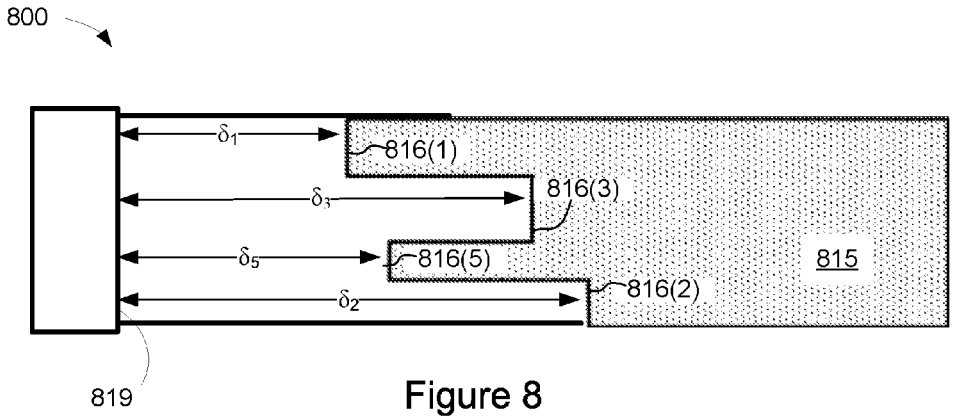
FIG. 8 shows an example of a septum of an OMT, according to a yet further implementation.

FIG. 8 provides an illustration of a septum 815 as disposed with respect to a port 819 of an OMT 800. In the illustrated implementation, a single notch segment 816(3) and a single protrusion segment 816(5) are disposed between a first edge segment 816(1) and a second edge segment 816(2). In the illustrated implementation, it may be observed that a distance $\delta_3$ between the notch segment 816(3) and the port 819 is greater than distance $\delta_1$ and less then distance $\delta_2$. It may also be observed that a distance $\delta_5$ between the protrusion segment 816(5) and the port 819 is greater than distance $\delta_1$ and less then distance $\delta_2$.

Figure 9:
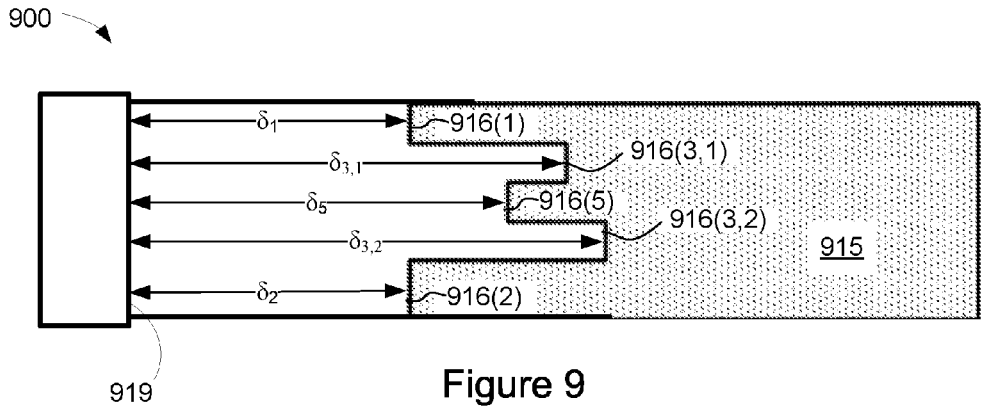
FIG. 9 shows an example of a septum of an OMT, according to an implementation.

FIG. 9 provides an illustration of a septum 915 as disposed with respect to a port 919 of an OMT 900. In the illustrated implementation, a single protrusion segment 916(5) is disposed between a first edge notch segment 916(3,1) and a second notch segment 916(3,2). In the illustrated implementation, it may be observed that a distance $\delta_5$ between the protrusion segment 916(5) and the port 919 is greater than the distance $\delta_1$ and the distance $\delta_2$.

Figure 10:
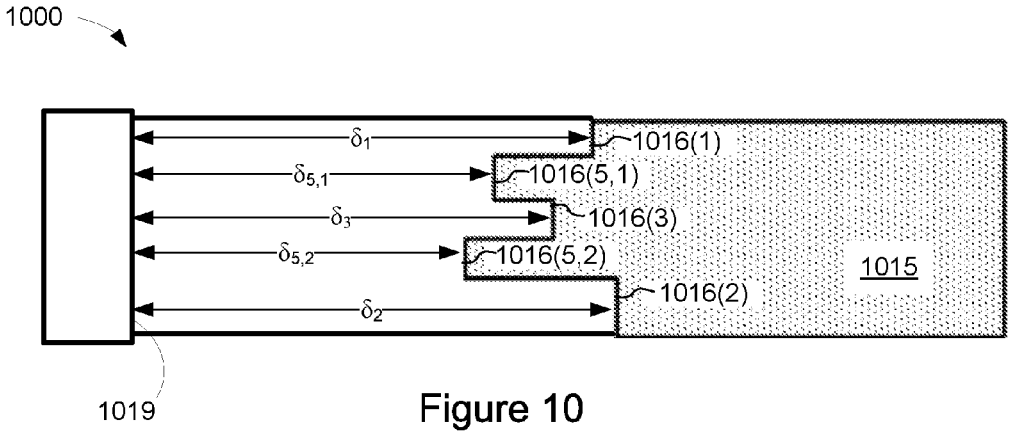
FIG. 10 shows an example of a septum of an OMT, according to another implementation.

FIG. 10 provides an illustration of a septum 1015 as disposed with respect to a port 1019 of an OMT 1000. In the illustrated implementation, a single notch segment 1016(3) is disposed between a first edge protrusion segment 1016(5,1) and a second protrusion segment 916(5,2). In the illustrated implementation, it may be observed that a distance $\delta_3$ between the notch segment 1016(3) and the port 1019 is less than the distance $\delta_1$ and the distance $\delta_2$.

Figure 11:
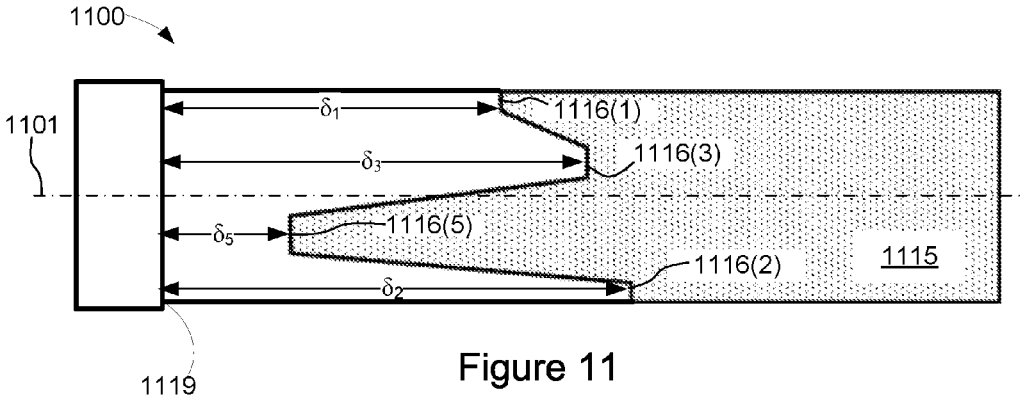
FIG. 11 shows an example of a septum of an OMT, according to a further implementation.
Figure 12:
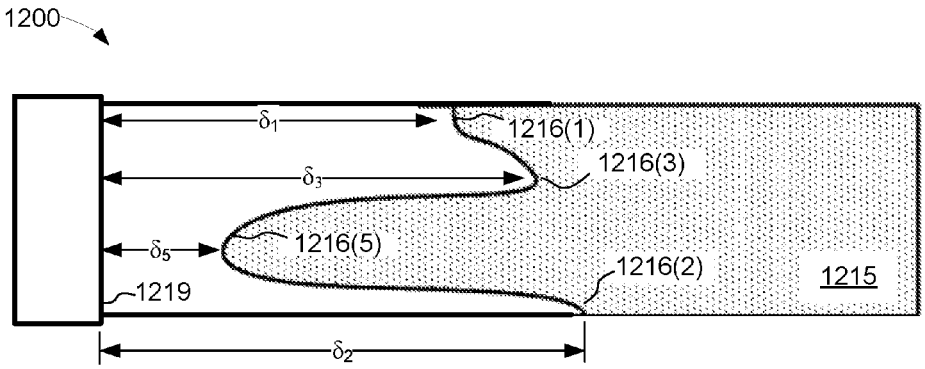
FIG. 12 shows an example of a septum of an OMT, according to a yet further implementation.

In the implementations described hereinabove, it may be observed that all edge segments are either parallel or orthogonal to a longitudinal axis of the OMT. However this is not necessarily true. FIGS. 11 and 12 illustrate examples of implementations where at least some of the edge segments are neither orthogonal to the longitudinal axis nor parallel to the longitudinal axis.

FIG. 11 provides an illustration of a septum 1115 as disposed with respect to a port 1119 of an OMT 1100. In the illustrated implementation, a single notch segment 1116(3) and a single protrusion segment 1116(5) are disposed between a first edge segment 1116(1) and a second edge segment 1116(2). Edge surfaces between each of first edge segment 1116 (1) and notch segment 1116(3), notch segment 1116(3) and protrusion segment 1116(5), protrusion segment 1116(5) and second edge segment 1116(2) are arranged at an acute angle with respect to longitudinal axis 1101. In the illustrated implementation, it may be observed that a distance $\delta_3$ between the notch segment 1116(3) and the port 1119 is greater than distance $\delta_1$ and less then distance $\delta_2$. That is, the notch segment 1116(3) extends a lesser distance toward the port 1119 than the second edge segment 1116(1). In the illustrated implementation, it may also be observed that a distance $\delta_5$ between the protrusion segment 1116(5) and the port 1119 is less than both of distances $\delta_1$ and $\delta_2$. Although in the illustrated implementation, first edge segment 1116 (1), notch segment 1116(3), protrusion segment 1116(5) and second edge segment 1116(2) are generally orthogonal to the longitudinal axis 1101, in some implementations a saw tooth pattern may be contemplated wherein protrusions and/or notches have a generally V-shaped configuration.

FIG. 12 provides an illustration of a septum 1215 as disposed with respect to a port 1219 of an OMT 1200. In the illustrated implementation, a single notch segment 1216(3) and a single protrusion segment 1216(5) are disposed between a first edge segment 1216(1) and a second edge segment 1216(2). In the illustrated implementation, edge surfaces are arranged in a curvilinear manner. In the illustrated implementation, it may be observed that a distance $\delta_3$ between the notch segment 1216(3) and the port 1219 is greater than distance $\delta_1$ and less then distance $\delta_2$. That is, the notch segment 1216(3) extends a lesser distance toward the port 1219 than the first edge segment 1216(1). In the illustrated implementation, it may also be observed that a distance $\delta_5$ between the protrusion segment 1216(5) and the port 1219 is less than both of distances $\delta_1$ and $\delta_2$.

Advantageously, each of the above described implementations is arranged such that, throughout the length of the facing edge, each segment of the facing edge is either parallel to the longitudinal axis or at least partly facing the third port. That is, there is a direct line of sight in a direction parallel to the longitudinal axis to every portion of the facing edge that is not actually parallel to the longitudinal axis. In other words the facing edge includes no portion facing away from the third port. The above-mentioned arrangement has been found to facilitate fabrication and inspection processes.

Thus, a compact orthomode transducer has been described. While various embodiments have been described herein, it should be understood that they have been presented by way of example only, and not limitation. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. An apparatus comprising:

an orthomode transducer (OMT), the OMT including a waveguide having a first port, disposed at a proximal portion of the waveguide and configured to propagate first linearly polarized signals, a second port disposed adjacent to the first port and configured to propagate second linearly polarized signals, a third port disposed at a distal portion of the waveguide and configured to propagate linear orthogonally polarized signals, and a septum disposed inside the waveguide, wherein:

the OMT is configured to perform one or both of combining or separating the first and second linearly polarized signals and the septum includes a facing edge, the facing edge including:

a first edge segment proximal to a first sidewall of the waveguide;

a second edge segment proximal to a second sidewall of the waveguide, and one or more of:

(1) a protrusion disposed between the first edge segment and the second edge segment that extends farther toward the third port than both of the first edge segment and the second edge segment; and (ii) one or more protrusions and notches, each protrusion extending farther toward the third port than one or more of the first edge, the second edge and at least one notch, each notch extending a lesser distance toward the third port than one or more of the first edge, the second edge and at least one protrusion.

2. The apparatus of claim 1, wherein each edge segment, protrusion and notch at least partly faces the distal portion of the waveguide.

3. The apparatus of claim 1, wherein the first port and second port include respective rectangular waveguide portions, each rectangular waveguide portion having a respective characteristic broad wall dimension and a respective characteristic narrow wall dimension.

4. The apparatus of claim 3, wherein the respective rectangular waveguide portions share a common broad wall.

5. The apparatus of claim 4, wherein the respective characteristic broad wall dimension is approximately two times wider than each respective characteristic narrow wall dimension.

6. The apparatus of claim 5, wherein the third port includes a square waveguide.

7. The apparatus of claim 1, wherein one or more of the first edge segment, the second edge segment, the protrusion and the notch are orthogonal to a longitudinal axis of the OMT.

8. The apparatus of claim 1, wherein one or more of the first edge segment, the second edge segment, the protrusion and the notch are not orthogonal to a longitudinal axis of the OMT.

9. The apparatus of claim 1, wherein at least a portion of the facing edge is a curvilinear surface.

10. The apparatus of claim 1, wherein the third port is configured to couple with a circular waveguide.

11. An antenna system, comprising:

a reflector; and a feed array, the feed array including a plurality of feed array elements, at least one of the feed array elements including:

an orthomode transducer (OMT), the OMT including a waveguide having a first port, disposed at a proximal portion of the waveguide and configured to propagate first linearly polarized signals, a second port disposed adjacent to the first port and configured to propagate second linearly polarized signals, a third port disposed at a distal portion of the waveguide and configured to propagate linear orthogonally polarized signals, and a septum disposed inside the waveguide, wherein:

the OMT is configured to perform one or both of combining or separating the first and second linearly polarized signals and the septum includes a facing edge, the facing edge including:

a first edge segment proximal to a first sidewall of the waveguide;

a second edge segment proximal to a second sidewall of the waveguide, and one or more of:

(1) a protrusion disposed between the first edge segment and the second edge segment that extends farther toward the third port than both of the first edge segment and the second edge segment; and (ii) one or more protrusions and notches, each protrusion extending farther toward the third port than one or more of the first edge, the second edge and at least one notch, each notch extending a lesser distance toward the third port than one or more of the first edge, the second edge and at least one protrusion.

12. The antenna system of claim 11, wherein each edge segment, protrusion and notch at least partly faces the distal portion of the waveguide.

13. The antenna system of claim 11, wherein the first port and second port include respective rectangular waveguide portions, each rectangular waveguide portion having a respective characteristic broad wall dimension and a respective characteristic narrow wall dimension.

14. The antenna system of claim 13, wherein the respective rectangular waveguide portions share a common broad wall.

15. The antenna system of claim 14, wherein the characteristic broad wall dimension is approximately two times wider than each respective characteristic narrow wall dimension.

16. The antenna system of claim 15, the third port includes a square waveguide.

17. The antenna system of claim 11, wherein one or more of the first edge segment, the second edge segment, the protrusion and the notch are orthogonal to a longitudinal axis of the OMT.

18. The antenna system of claim 11, wherein one or more of the first edge segment, the second edge segment, the protrusion and the notch are not orthogonal to a longitudinal axis of the OMT.

19. The antenna system of claim 11, wherein at least a portion of the facing edge is a curvilinear surface.

20. The antenna system of claim 11, wherein the third port is configured to couple with a circular waveguide.

* * * * *